United States Patent [19]

Michelson

[11] 4,050,690

[45] Sept. 27, 1977

[54] DOCUMENT SEPARATOR MECHANISM

[75] Inventor: Gunnar P. Michelson, Van Nuys, Calif.

[73] Assignee: NCR Corporation, Dayton, Ohio

[21] Appl. No.: 723,693

[22] Filed: Sept. 16, 1976

[51] Int. Cl.[2] ..... B65H 3/46

[52] U.S. Cl. ..... 271/125; 271/11; 271/34; 271/265; 271/273

[58] Field of Search ..... 271/10, 11, 34, 35, 271/104, 117, 121, 122, 124, 125, 137, 167, 258, 265, 273, 274

[56] References Cited

U.S. PATENT DOCUMENTS

| | | | |
|---|---|---|---|
| 2,856,187 | 10/1958 | Burckhardt et al. | 271/265 X |
| 3,108,801 | 10/1963 | Van Dalen | 271/34 X |
| 3,885,782 | 5/1975 | Wright et al. | 271/10 |
| 3,994,211 | 3/1976 | Rasmussen et al. | 271/122 X |

*Primary Examiner*—Robert W. Saifer
*Attorney, Agent, or Firm*—J. T. Cavender; Wilbert Hawk, Jr.; George J. Muckenthaler

[57] ABSTRACT

A drive roller and a driven, braked, retard roller are juxtaposedly positioned along the path of documents being transported beyond a document feeding mechanism to provide passage of only one document at a time. The retard roller is carried on an arm which is swingable on a pivot and lightly spring loaded against the drive roller, such arm being placed and positioned at a certain angle rearward of a line extending perpendicular from the document, this angle being larger than the friction angle of document against document, but smaller than the friction angle of document against roller. A single document will pass between the rollers with both rollers rolling at the same speed, whereas when two documents attempt to pass between the rollers at the same time the second document will be retarded by the retard (braked) roller. When both the retard roller and the second document have come approximately to a near stop or standstill, such attitude is sensed at the retard roller, and the retard roller is lifted off or swung away from the documents to give the first document a head start, whereupon the retard roller is re-engaged after a certain short period of time to start the second document on its journey.

10 Claims, 3 Drawing Figures

DOCUMENT SEPARATOR MECHANISM

BACKGROUND OF THE INVENTION

In the field of document feeding, separating, and sorting there have been many different mechanisms and devices designed to feed and to convey or transport such documents along a path wherein it is important that each and every document being transported follows in successive manner and that two or more documents do not overlap during the time of transport.

Several of such designs include the use of a drive member cooperating with an adjacent member which may be driven in the opposite or counter rotation, the use of an idler member driven at a slower speed than the drive member, and the use of retardant materials in the idler structure to restrict the passage of a plurality of documents past a given station. Various ways and means of accomplishing certain results include the use of frictional surfaced belts or rollers which are somewhat controlled with pressure or resilient means, linkages, or variations in symmetry to provide a variable throat for passage of only one document at any one time.

Representative prior art in the document separating field includes U.S. Pat. No. 3,025,051 issued to B. F. David et al. which discloses sheet handling apparatus and method wherein a separator or drive wheel cooperates with a restraint belt driven in the opposite direction, the belt being tensioned by means of an idler pulley carried on a lever which is biased by a spring to provide an adjustable throat between the wheel and the belt. U.S. Pat. No. 3,635,465 issued to J. Beery discloses a document separator control system wherein a drive wheel cooperates with a belt trained around a pair of guide wheels, there being a pair of movable guide rollers carried on a Y-member and connected to the guide wheels by links, with the Y-member being directly actuated by a linear actuator to provide altering of the path of the belt to maintain the frictional forces. And, U.S. Pat. No. 3,861,670 issued to W. A. Kraft discloses sheet feeding apparatus wherein a feed roller is carried on a shaft and cooperates with a retard roller, the feed roller having a first portion engaging with the retard roller and a second portion engaging the sheet. The retard roller is eccentrically carried on a shaft which is pivotally biased by a spring to move the retard roller between operative and inoperative positions.

SUMMARY OF THE INVENTION

The present invention relates to a document transport system and more particularly to mechanism for controlling the traveling position of each document as it moves from a document hopper and succeeding feed unit past a document separating apparatus and on towards transport mechanism. Although the documents or checks are usually placed in the hopper in random manner, the feed unit is intended to pick off each document from a stack or pile thereof and initiate individual and successive flow of the documents along a path for processing of each document. In this respect, however, the feed unit sometimes advances more than one document at a time and it is highly desirable that documents emerging from the feed apparatus be in singular position as they are advanced to the processing areas. The present invention provides for separating mechanism wherein at least one friction-surfaced drive wheel is positioned on the inside track of the path of documents to cooperate with a friction-surfaced, braked, retard or pinch roller positioned on the outside track of the document path. The retard roller is carried on an arm which is swingable in a small angle about a pivot point distal from the retard roller, such roller acting as a brake or retard element on each document as it passes the drive roller. The arm is set at a certain separation angle against the document, this angle being taken between a line through the contact point between the rollers, perpendicular to the face of the document, and a line through the pivot point of the arm and the contact point between the rollers. The separation angle must be larger than the friction angle of document against document but smaller than the friction angle of document against roller, which latter friction angle depends on the roller lining material and should be as high as possible. Since the separation angle is very critical, the arm is pivoted on a separate plate which can be rotated for adjustment about the average contact point of the rollers. The retard roller is lightly preloaded against the drive roller, either by pivoting the arm on a pivot pin with a preload spring acting on it, or by using a short leaf spring as a back-lash free, non-wearing pivot which, also, provides the preload.

When a single document passes between the rollers, the rollers will continue to rotate and the document will pass at its normal speed since the ratio of the friction force between the rollers and the document to the normal force on the document is smaller than the coefficient of friction between the rollers and the document, and is not large enough to cause the rollers to slip on the document. This ratio is independent of the magnitude of the braking torque.

When two documents simultaneously pass between the rollers, the ratio of the friction force between the two documents and the rollers to the normal force on the documents is larger than the coefficient of friction between the two documents which will allow the two documents to slip against each other. Thus, the first document will continue its travel at full speed whereas the second document and the retard (braked) roller will be decelerated, the magnitude of the deceleration depending on the mass of the document, the moments of inertia of the retard roller and of the brake, and the brake torque. The minimum required brake torque is dictated by the condition that the second document must come approximately to a stop or standstill before the trailing edge of the first document passes the roller contact point. For high-speed documents the brake torque and the brake power to be dissipated from the brake may become substantial. It is, therefore, of utmost importance to keep the massess and moments of inertia of the moving parts small.

For determination of the instant at which the retard roller has approximately come to a stop or standstill, a pulse generator is disposed at the retard roller which delivers a certain number of pulses per each revolution of the retard roller. The time increment between the pulses is measured and when a time increment exceeds a certain, predetermined value, it means that the document has slowed down sufficiently or has come to a standstill. At this point, the retard roller is disengaged from the documents by means of a solenoid acting on the arm. After a certain waiting period, long enough to permit the first document to get sufficiently past the contact point between the rollers, the solenoid is deenergized which causes the arm to pivot back to its original position, thereby re-engaging the retard roller with the second document and re-starting the latter on its journey.

In view of the above discussion, the principal object of the present invention is to provide an improved separating mechanism of the drive roller and braked, retard roller design.

Another object of the present invention is to provide a separating mechanism which permits one document to be driven therethrough while retaining a second document for a predetermined period of time prior to driving thereof.

A further object of the present invention is to provide a drive member and a braked, retard member cooperating therewith wherein the retard roller is carried by a member pivoted and positioned to include an angle between the perpendicular of the document plane and between the pivot point-retard roller plane to permit advancing one document at a time.

An additional object of the present invention is to provide a pulse generator or similar means at the braked retard roller which defines the speed of the retard roller.

A further object of the present invention is to provide actuator means including associated electronics which disengages the braked, retard roller from the document for a predetermined period of time once the speed of the retard roller has dropped below a certain, predetermined value.

Additional advantages and features of the present invention will become apparent and fully understood from a reading of the following description taken together with the annexed drawings, in which.

Figure 1:
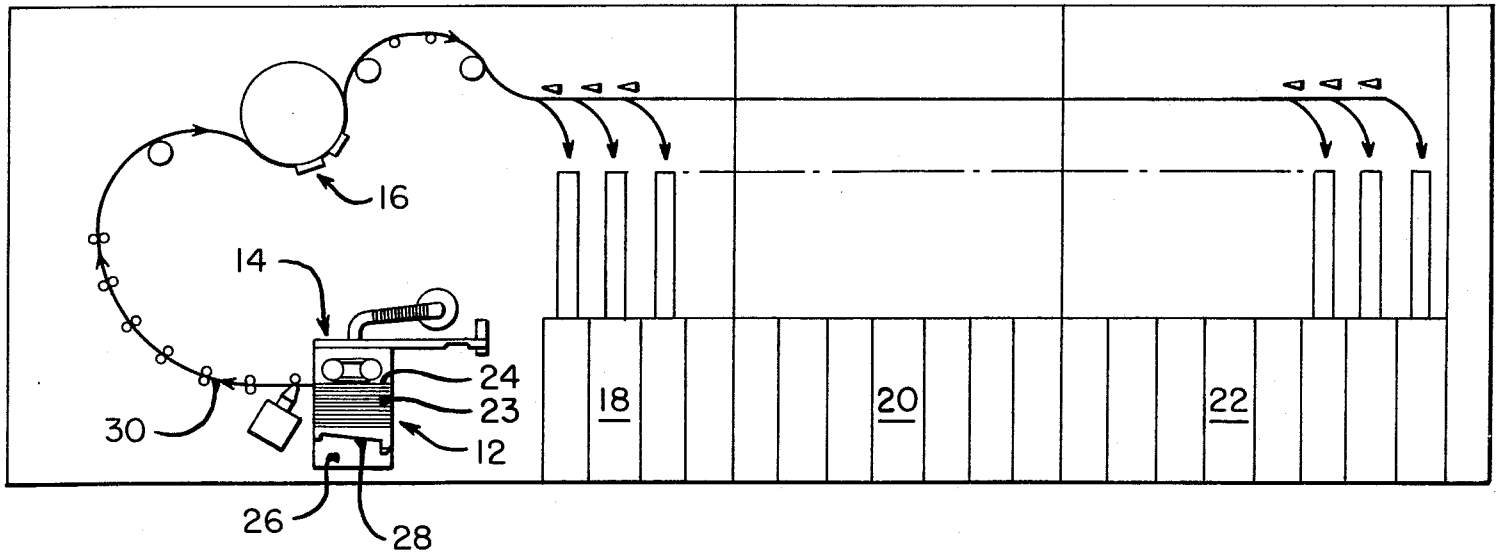
FIG. 1 is a plan view, in diagrammatic form, of document transport mechanism incorporating the subject matter of the present invention.

Referring now to the drawing, FIG. 1 shows a plan view, in diagrammatic form, of the arrangement of the various areas or sections of a document sorting machine, there being generally a hopper section 12, a feeder area 14, a read area 16 (a write or endorse area, if desired, may be adjacent or downstream of the read area) and stacking or pocket areas 18, 20 and 22. The path of the documents beyond the feeding and separating mechanisms, and also the pocket areas include structures which are the subject matter of two co-pending application, respectively, Ser. No. 723,687, filed Sept. 16, 1976 and Ser. No. 723,694, filed Sept. 16, 1976, and assigned to the same assignee as the present application. The pocket area 18 is a basic unit which may be utilized for limited operation and which may include, for example, 1–6 pockets, the pocket area 20 being an add-on unit to provide more pockets, say a total of 12 pockets, and the pocket area 22 being a further add-on unit to provide still more pockets for the sorted checks or documents. The number of pockets, of course, will depend upon the extent of the operation desired or necessitated by the results to be obtained. Generally, these document sorters are set up in modular fashion wherein the number of pockets in each module may be a multiple of six, and wherein an extra pocket is provided at the end of the machine to accommodate those documents which are not selected for a particular pocket.

The hopper section 12 is set at an angle upwardly toward the feeder area 14, there being a stack 23 of documents 24 in the hopper 26. These documents are urged by an arm 28 (FIG. 1 and FIG. 2) upwardly on an angle toward the feeding mechanism which feeds each document into the document transport path 30 and toward the pocket area. The feed mechanism includes generally a pair of feed pulleys 32 and 34 with at least one belt 36 trained therearound, although the specific construction includes five belts around pulleys stacked to provide feed or drive means for each document. The feed mechanism is driven by an appropriate motor (not shown) and is supported in cantilever manner by means of an arm 38, having a reduced portion 40 for certain flexibility therein, and secured to the frame of the document sorter by a bolted bracket 42. Vacuum means in the form of a pump 44 and a hose 46 is utilized to draw the uppermost document 24 against the drive belts 36 so as to provide positive feeding of each document in successive manner.

As each uppermost document 24 is driven from the stack 23 thereof, it is directed toward and through a throat 48 (FIG. 2) formed by a drive roller 50 and a retard roller 52 (see also FIG. 3), the drive roller 50 being the first of a plurality of drive members positioned along the document path 30 to maintain driving force on the documents 24 as they are successively transported toward the pocket area. The succeeding drive rollers 54 and idler rollers 56 form no part of the present invention and will not be further described herein.

Figure 2:
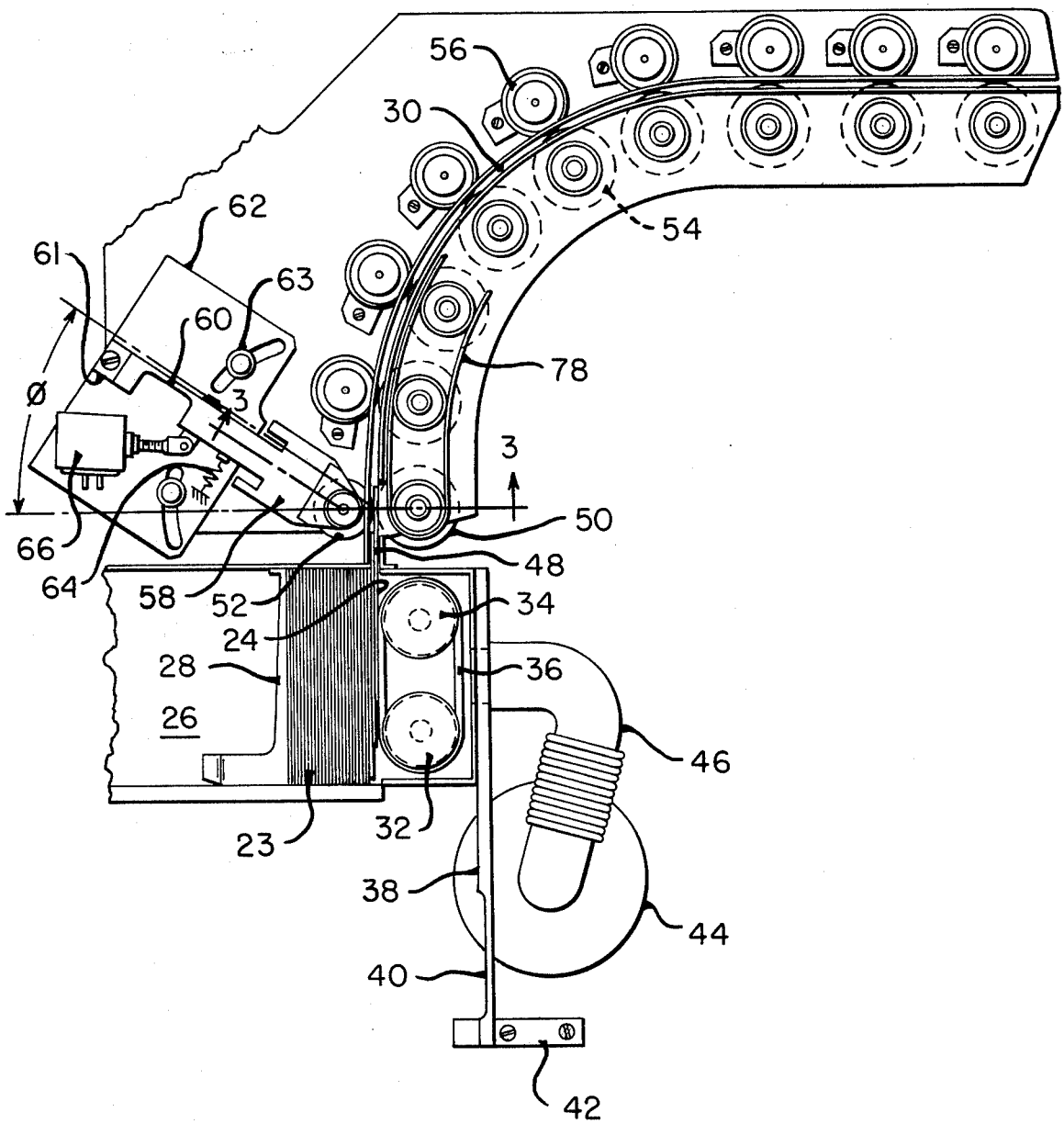
FIG. 2 is an enlarged plan view showing the preferred construction of the present invention.

The retard roller 52 is journaled on an arm 58, having a flexible portion 60 which acts as a pivot to provide a small movement of the retard roller 52 in the separation and control of the checks or documents as they are fed from the hopper 26 and along the path 30. Both the retard roller 52 and the drive roller 50 have a high-friction periphery, e.g., made of rubber or a similar material. As seen in FIG. 2, the drive roller 50 is driven in a clockwise direction and the retard roller is caused to be rotated in a counterclockwise direction.

The angle $\phi$, formed by a line through the flexible portion 60 of arm 58 and the contact point of rollers 50 and 52, and a line perpendicular to the face of the document and going through the contact point of rollers 50 and 52, must be larger than the frictional angle of paper to paper and smaller than the frictional angle of paper to rubber to permit operation of the retard roller 52 in cooperation with the drive roller 50.

The frictional angle, of course, is defined as the arc tangent of the coefficient of friction. Typically, the coefficient of friction between paper and paper is in the range of 0.18 to 0.50, depending on the type of paper, the surface condition of the paper, the ambient humidity, and other factors. The coefficient of friction between paper and a rubber roller is in the range of 0.50 to 1.00, depending on the hardness, age, and cleanliness of the rubber. Thus, for example, when selecting an angle $\phi$ of 26.6°, the arc tangent of which is 0.50, (or a larger angle for a clean, soft rubber roller), most of the documents will be separated successfully. The end 61 of arm 58 is mounted to a plate 62 which, for adjustment of the angle $\phi$, can be rotated about the contact point of rollers 50 and 52 and which is adjustably secured to the frame of the sorter by means of screws 63.

Figure 3:
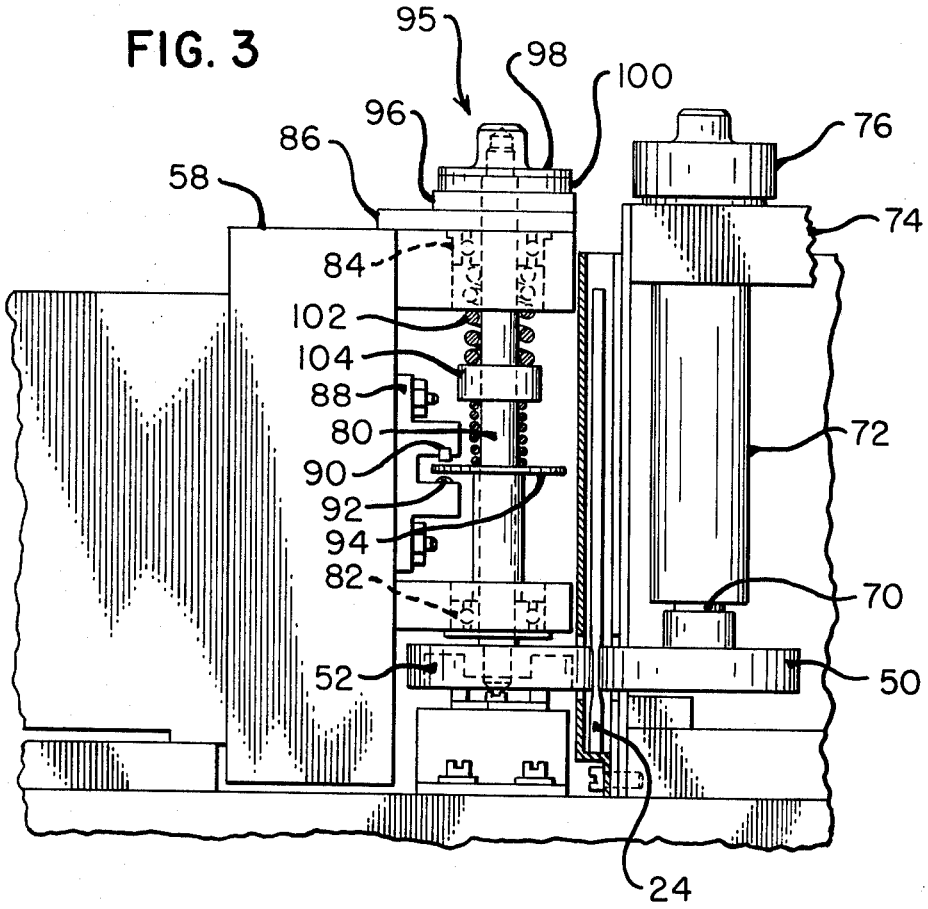
FIG. 3 is a view taken on the plane 3—3 of FIG. 2.

In FIG. 3 is shown an elevational view in the document separating area wherein the inlet drive roller 50 is secured to one end of a shaft 70, the shaft being journaled in a bushing 72 secured in a frame member 74 and having a drive pulley 76 secured to the shaft 70 at the other end for driving thereof to rotate the drive roller 50 and thereby advance the documents 24. A belt 78

(FIG. 2) may be trained about the pulley 76 and additional drive pulleys for the drive rollers 54 positioned along the path 30 of document travel.

Cooperating with the drive roller 50 is the retard roller 52 which is secured to one end of a shaft 80 which shaft is carried in bearings 82 and 84 and supported by suitable framework 86. While only one of the documents 24 is normally being advanced by the drive and retard rollers as described above, the retard roller 52 and its supporting structure are pivoted about the point 60 (FIG. 2) so as to permit the retard roller 52 to move a slight amount in relation to the drive roller 50 when two documents are attempting to get into the throat 48 and past the drive and retard rollers without separation thereof.

A photoelectric control member 88 (FIG. 3) is mounted to the arm 58. Its light beam, going from the light source 90 to the sensor 92 is pulsed by means of the rotating segmented dise 94, secured to the shaft 80 of the retard roller 52. When the period of time between two consecutive pulses exceeds a certain predetermined value, and when the roller 52 and the document 24 have slowed down to a very low speed or have come to a complete halt, the associated electronics (not shown) energizes the solenoid 66 (FIG. 2) which lifts or moves the retard roller 52 off the document 24 by means of the arm 58. This is necessary to prevent a premature re-engagement of roller 52 and re-starting of the retarded document. After a predetermined safe period of time, the solenoid 66 is de-energized and the spring 64 (or the elastic force of the flexible positon 60 of arm 58) returns the arm 58 to its original position thereby re-engaging the retard roller 52 with the document 24 and restarting the latter on its journey.

A brake 95 (FIG. 3) is provided to continuously brake the retard roller 52. It consists of a fixed brake disc 96 attached to the framework 86, a rotating brake disc 98 attached to the retard roller shaft 80 and lined with brake lining 100, and a spring 102 adjacent a member 104 and which presses both brake discs together thus creating the brake torque.

In the operation of the document separating mechanism, the feed mechanism belts 36 normally drive one document 24 from the stack 23 thereof with the aid of the vacuum means 44, 46 and cause the documents 24 to be moved toward and through the throat 48 and along the path 30 to the sorter pocket areas 18, 20, and 22. As each document 24 arrives at the throat 48, the arm 58 and the retard roller 52 are in normal position and the retard roller is rotating in cooperation with the drive roller 50, however, when two documents attempt to pass through the throat 48 between the drive roller 50 and the retard roller 52, the two documents begin to slip on each other and the retard roller 52 and the document adjacent thereto slow down as described above. The sensor 92 is pulsed by the light beam passing through the slots in the segmented disc 94. Due to the slowing down of the retard roller 52 by reason of the additional friction being placed thereon, the period of time between sensor pulses increases. When this period of time exceeds a predetermined value, which means that the retard roller and the document adjacent thereto have slowed down sufficiently or have come to a stop, the solenoid 66 is energized to swing the arm 58 and the roller away from the normal operating position. As a result of this motion, the documents 24 are no longer pinched between the rollers 50, 52 and the rollers no longer exert any tangential forces on the documents, except for small friction forces when the documents accidentally touch each other or touch the rollers. These accidental forces are small and have little bearing on separation of the documents. Thus, when pinching of the documents is removed by reason of the retard roller swinging from the normal operating position, the document 24 adjacent the drive roller 50 will continue to move by reason of the forward inertia at a high or full speed whereas the document 24 adjacent the retard roller 52 will maintain a very low speed or come to a stop. Thus, because of the vastly different speeds of the documents, the separation of the two documents will be extremely fast in operation. A typical speed for moving documents is 300 inches per second and, at this speed, the kinetic energy of the documents is corresponding to a free fall height of approximately 117 inches. It is quite apparent that, compared to the large kinetic energy, the small amounts of energy introduced into the documents by their accidentally touching each other or the rollers does not appreciably change the operation of document separation. After the set period of time, the solenoid is de-energized and the arm 58 returns the retard roller 52 to the normal position of engagement with the document 24.

By way of further describing the action which takes place when two documents approach and enter the throat 48 formed by the drive roller 50 and the braked, retard roller 52, the first document or that document adjacent the drive roller 50, of course, has an inertia of movement contained therein by reason of the drive or feed pulleys 32, 34 and the belts 36 acting on the document to feed the document through the throat 48, the drive roller 50 continuing the driving of the document towards the transport rollers 54. The second document or that document adjacent the retard roller 52 is slowed by the additional friction imposed on the retard roller, thus causing the retard roller to slow, it being recalled that the retard roller is subjected to a braking action. As mentioned above, when the retard roller 52 comes almost to a stop, the solenoid 66 is energized and the roller 52 moves or swings slightly from the adjacent document, and since there is no driving force on such document by reason of decreased friction between the roller 52 and the document, and by the almost non-existent frictional force between the two documents, the second document is not caused to be advanced and in effect is delayed in its travel through the throat 48. After the predetermined amount of time to permit the first document to be advanced past the drive roller 50, the solenoid 66 is de-energized and the retard roller 52 is again caused to be moved or swung against the second document, wherein the frictional force again takes effect on the document and it is caused to be driven through the throat 48. In this manner, it is seen that the retard roller 52, upon being moved or swung slightly from the point of contact with the drive roller 50, is disposed at an angle rearward of the normal or the perpendicular to the surface of the document. Since, as mentioned above, the tangent of the frictional angle, being the ratio of the friction force between the two documents and the rollers to the normal force on the documents, is greater than the coefficient of friction between the two documents, the documents will easily slip on each other and permit the fast moving document to be advanced through the throat 48 while the slowed document is delayed until re-engaged by the two rollers. When the re-engagement takes place, the slowed document between the drive roller 50 and the retard roller 52 is accelerated by reason of contact by the drive roller until the document 24 has again reached its operational speed.

It is thus seen that herein shown and described is a document separating apparatus which prevents the driving of two documents along the path toward the pocket area and provides for successive movement of such documents. The apparatus enables the accomplishment of the objects and advantages mentioned above, and, while only one embodiment of the invention has been disclosed herein, variations thereof may occur to those skilled in the art. It is contemplated that all such variations, not departing from the spirit and scope of the invention hereof, are to be construed in accordance with the following claims.

What is claimed is:

1. Mechanism for separating documents in singular manner from a stack thereof, comprising feed means engageable with the documents for initiating movement thereof;

drive means adjacent said feed means and engageable with the documents for advancing thereof after initial movement, and retard means cooperating with said drive means for advancing the documents in singular manner, said retard means including roller means carried on a member pivotally supported distal from said roller means and movable from said drive means when more than one document is present at the point of contact between said drive means and said roller means, said retard means further including timing means measuring advancement of one document in relation to a predetermined time whereby one document is driven by said drive means and another document adjacent said one document is restrained by said retard means until said one document has been advanced beyond said drive means.

2. The mechanism of claim 1 wherein said feed means includes a plurality of belts movable toward and away from the stack of documents for initiating movement of the documents.

3. The mechanism of claim 1 wherein said drive means includes a drive roller adjacent said retard roller means for providing a throat therebetween, said retard roller means being swingable from said drive roller to expand said throat and cause one document to be advanced therethrough at a time.

4. The mechanism of claim 1 wherein said retard roller means has a frictional surface thereon, and said retard roller means carrying member is disposed at an angle rearward of a perpendicular from the document larger than the frictional angle between two documents and smaller than the frictional angle between a document and the frictional surface of the roller member.

5. The mechanism of claim 4 wherein said retard roller means carrying member includes a spring member to urge said roller means into contact with said drive means, said timing means timing the rotation of said retard roller means and causing the swinging of said retard roller means carrying member upon more than one document moving past said drive means to permit driving of one document thereby prior to the driving of another document thereby.

6. In document sorting apparatus having a document hopper, feed mechanism at one end of said hopper for initiating movement of documents from said hopper, and means for separating the documents in single manner prior to transporting thereof, said separating means including drive means adjacent said feed mechanism for advancing the documents, and retard means cooperating with said drive means and having a braked retard roller juxtaposed said drive means, said retard means including arm means carrying said roller and pivotally supported distal from said retard roller and swingable from said drive means when more than one document is present at the point of contact between said drive means and said retard roller, the presence of more than one document increasing the friction between the retard roller and the document adjacent thereto and slowing the rotation of said retard roller, and said retard means including disc means rotatable with said retard roller for timing the advancement of one document in relation to a predetermined time thereby permitting driving of one document past said drive means and restraining an adjacent document by said retard means until one document has been advanced beyond said drive means.

7. In the apparatus of claim 6 wherein said drive means includes a drive roller defining the fixed side of a throat, said retard roller defines a movable side of said throat and is swingably disposed at an angle rearward of a perpendicular from the document to permit driving of only one document at any one time through said throat.

8. In the apparatus of claim 7 wherein said drive roller and said retard roller each includes a frictional surface thereon, said angle of disposition of said retard roller being larger than the frictional angle between two documents and smaller than the frictional angle between a document and the frictional surface of the retard roller.

9. In the apparatus of claim 6 wherein said retard means includes a spring member against which said retard roller is urged in swingable movement thereof, said timing means timing the rotation of said roller and the swinging of said retard means upon more than one document moving past said drive means to cause driving of one document therepast prior to driving another.

10. In the apparatus of claim 6 wherein said drive means includes a shaft having a drive roller secured at one end thereto and said retard means includes a shaft having the retard roller journaled thereon, said drive and retard rollers forming a throat therebetween for passage of documents therethrough, and said retard means including an arm member supporting said retard shaft and roller and having a reduced portion therein for permitting pivoting of said retard roller in swinging movement toward and from said drive roller.

* * * * *